US007093869B2

(12) United States Patent
Jung

(10) Patent No.: US 7,093,869 B2
(45) Date of Patent: Aug. 22, 2006

(54) ANIMAL WASTE COLLECTION DEVICE

(76) Inventor: Koock Jung, 597 Bay Rd., Queensbury, NY (US) 12804

( * ) Notice: Subject to any disclaimer, the term of this patent is extended or adjusted under 35 U.S.C. 154(b) by 105 days.

(21) Appl. No.: 10/812,633

(22) Filed: Mar. 30, 2004

(65) Prior Publication Data

US 2005/0218675 A1 Oct. 6, 2005

(51) Int. Cl.
*A01K 29/00* (2006.01)

(52) U.S. Cl. ..... 294/1.4

(58) Field of Classification Search ..... 294/1.4, 294/1.2, 1.3; 15/257.6, 257.7
See application file for complete search history.

(56) References Cited

U.S. PATENT DOCUMENTS 3,986,744 A * 10/1976 Krogstad et al. ..... 294/1.3
4,225,174 A * 9/1980 Hennessy et al. ..... 294/1.4
5,503,442 A * 4/1996 Lee ..... 294/1.4

* cited by examiner

*Primary Examiner*—Eileen D. Lillis
*Assistant Examiner*—Esther Onyinyechi Okezie

(57) ABSTRACT

An animal waste collection device allows collection of waste into a bag without soiling a user. The animal waste collection device comprises an elongated handle that comprises an actuator assembly at one end; a pick-up and collection device disposed at the other end of the elongated handle and a pick-up and collection device disposed at an end of the elongated handle from the actuator assembly. The pick-up and collection device comprising movable collection members movably connected to an elongated base member. A linkage is operably connected to the actuator assembly and extends between the actuator assembly and the pick-up and collection device. A transmission element is operably connected to the linkage at the pick-up and collection device and is operably connected to the movable collection members for transmitting movement to move each of the movable collection members between open and closed movable collection members positions. The pick-up and collection device is adapted to receive a bag for receiving and storing animal waste collected by the animal waste collection device.

16 Claims, 8 Drawing Sheets

ANIMAL WASTE COLLECTION DEVICE

BACKGROUND OF THE INVENTION

This invention relates to U.S. Pat. No. 6,237,972 issued May 29, 2001, to the instant inventor Koock E. Jung, and U.S. patent application Ser. No. 10/719,156, filed Nov. 21, 2003, by Jung. The contents of both are fully incorporated by reference herein.

The invention relates to an animal waste collection devices and methods. In particular, the invention relates to an animal waste collection devices and methods that are used in combination with a bag for collecting, storing, and disposing of the animal waste.

It has been said that the American population is outnumbered by their pets. We are said to be outnumbered by our pet dogs alone, which number more than 250 million by some estimates. As these numbers increase, the public demand for animal regulation increases correspondingly, responsive to the public health and safety concerns related to the high population of pet animals.

Generally, pet owners residing in municipal regions are subject to ordinances requiring that their animals be leashed at all times in public, and restrained in private to prevent uncontrolled wandering. Recently, some municipalities have promulgated so-called "pooper-scooper" ordinances, which require pet owners to accept personal responsibility for collection and disposition of the waste material produced by their pet animals. A typical ordinance instituted recently provides that to avoid criminal charges, you must immediately place the waste in a plastic bag, securely tied, and then place it in a solid waste container. The enforcement of some ordinance specifies fines, jail time, and probation as penalty for violation. Clearly, the social trend that started years ago in the cities has now spread to the entire country, including some rural areas.

When pet owners are subject to both leash-laws and pooper-scooper ordinances, the owner is obliged to (a) "walk" their pet on a leash and (b) retrieve and dispose of pet wastes when and where the animal decides to relieve itself. This distasteful routine is familiar to all responsible dog owners and many bystanders. Because of the distastefulness of this routine, many less responsible dog owners leave the waste where it lies. A local legislative body may respond to this problem by instituting severe sanctions for such behavior, such as the type of penalties exemplified above. Practitioners in the art respond to the problem by proposing means designed to minimize the unpleasantness of the gathering and disposal of such animal waste.

For instance, the term "pooper-scooper" originally denominated a long-handled mechanical apparatus, which is well-known in the art. A pooper-scooper is used for retrieving dog wastes without soiling the owners' hands. Unfortunately, the first such pooper-scoopers were large and awkwardly-configured devices that were inconvenient to carry and often soiled in use. In using this or later versions and designs of pooper-scoopers, a rigid tray or scoop is employed to scoop up the waste material as best as possible. This design often soiled both the vicinity of the waste and the tray itself. Further, this design and others often require use of both hands, which is extremely difficult when holding a pet's leash.

Even if a disposable bag is placed within the tray, no means are provided for cleanly gathering all of the waste material into the bag. This omission usually obliges the user to employ a twig, branch, or other readily-available item as a tool or scraper for manipulating the waste material from its lie into the bag.

Responsive to this problem, it has been proposed to add a spring-loaded clip to the bottom of a scoop for retaining a disposable plastic bag in position while "scooping" the waste material. While such an improvement may assist in solving the problem of holding the disposable bag in position for use, it may not do anything to improve the gathering operation. The user may still be obliged to grab the nearest twig or other suitable disposable scraper to gather the material into the bag. As every pet owner knows, a simple unaided scooping action relying on collection by gravity alone is not sufficient to gather and retain looser material into a bag held only on one side.

Accordingly, pet-owners (and others) are often confronted with pet waste that can be collected using only an awkward scoop or shovel or, worse, a simple plastic bag for use together with whatever other "tools" may be afforded by their immediate environment. Human nature being what it is, such unpleasant pet waste is commonly left where it lies, creating social, public-health, and legal problems for the pet owner and others. Other solutions known in the art such as, but not limited to, disposable surgical gloves, paper tissues, sandwich bags and the like do little to reduce the well-known unpleasantness of the pet sanitation task. None of these alternatives provides for simple sanitary gathering and bagging of pet waste.

Further, the waste pick-up device should be convenient to carry and easy to operate. Devices that require simultaneous use of both hands presents a problem with respect to retention of the pet leash. If the waste pick-up device requires two hands for use the leash must be put down, which is undesirable since the pet may run away, slipping of the leash onto a wrist, which is undesirable as retention of the leash is difficult and operation of the waste pick-up device is considerably hindered.

Devices such as those described in U.S. Pat. No. 5,370,431 to Henninger et al. and U.S. Pat. No. 5,335,952 to Clapper both describe improvements to the above described pooper-scoopers and waste pick-up devices. However, each of these improvements still presents drawbacks in the complex, often two-handed, manipulation in inverting a bag used therewith, and possible user contact with the waste, both of which are undesirable.

Accordingly, a need exists in the art for a waste pick-up device that solves the above described problems. Further, a need exists for an animal waste collection device that is not awkward to use, needs only one hand to operate, environmentally friendly, and avoids the general distastefulness associated with gathering and disposing of pet waste. These problems and deficiencies are addressed by the invention, as described below.

SUMMARY OF THE INVENTION

An aspect of the invention provides an animal waste collection device. An animal waste collection device allows collection of waste into a bag without soiling a user. The animal waste collection device comprises an elongated handle that comprises an actuator assembly at one end; a pick-up and collection device disposed at the other end of the elongated handle and a pick-up and collection device disposed at an end of the elongated handle from the actuator assembly. The pick-up and collection device comprising movable collection members movably connected to an elongated base member. A linkage is operably connected to the actuator assembly and extends between the actuator assembly and the pick-up and collection device. A transmission element is operably connected to the linkage at the pick-up and collection device and is operably connected to the movable collection members for transmitting movement to move each of the movable collection members between open and closed movable collection members positions. The pick-up and collection device is adapted to receive a bag for receiving and storing animal waste collected by the animal waste collection device.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

Figure 1:
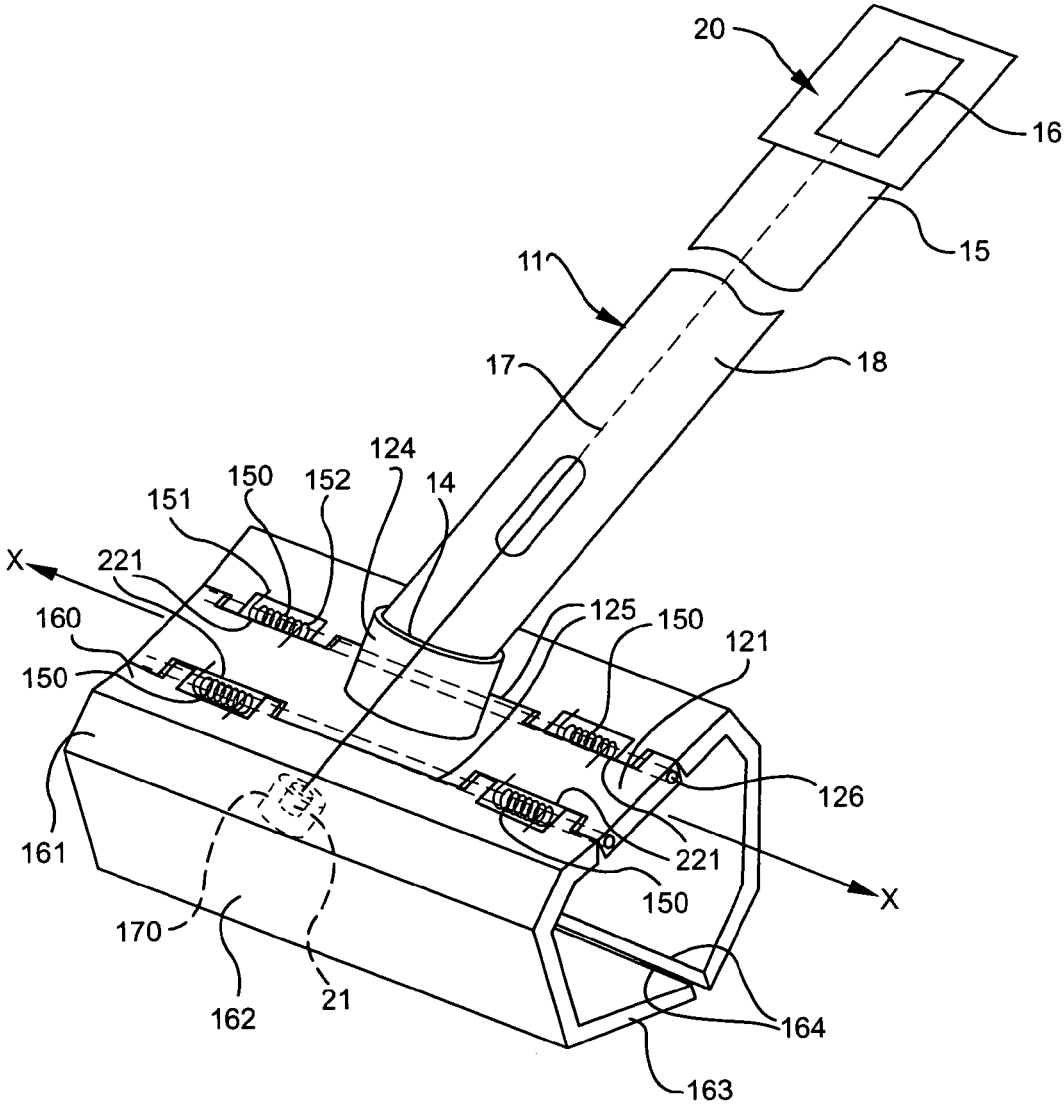
FIG. 1 is a schematic illustration of an animal waste collection device, as embodied by the invention.

An animal waste collection device, as set forth herein, provides a clean, convenient device for collecting animal waste for one-handed animal waste collection. The animal waste collection device 1 is illustrated in FIG. 1, with details of the animal waste collection device illustrated in FIGS. 2–5. The figures set forth exemplary configurations of the animal waste collection device, as embodied by the invention, which are intended for illustrative purposes.

In FIG. 1, the animal waste collection device 10 comprises an elongated handle 11, a pick-up and collection device 12, and a disposable animal waste collection bag (not illustrated for ease of understanding the animal waste collection device, as embodied by the invention). The handle 11 is attached to the pick-up and collection device 12 at a first end 14. A second end 15 of the handle 11 comprises a handle assembly with a gripper element 16 (hereinafter "handle assembly"), which is schematically illustrated in FIG. 1 and an actuator assembly 20 for a user to support and operate the animal waste collection device 10, as described hereinafter.

The animal waste collection device 1, as embodied by the invention, comprises at least one linkage to allow user of the animal waste collection device 1 to open and control the pick-up and collection device 12. The animal waste collection device 1 can include one linkage 17 and preferably comprises two linkages as illustrated herein. For simplicity of description, only one linkage will be described.

Each linkage 17 extends the length of the elongated handle 11. Each linkage 17, as embodied by the invention, extends the length of the elongated handle 11, partially on an exterior of the elongated handle 11, in the proximity of the pick-up and collection device 12, and in an interior 18 of the elongated handle 11. Alternatively, the linkage 17 can extend the length of the elongated handle 11 on an exterior surface of the elongated handle 11, (not illustrated) if the elongated handle 11 comprises a solid elongated handle without an interior. An end of the linkage 17 is operably connected to and extends from the actuation assembly 20, which moves the linkage 17 for operating the pick-up and collection device 12 of the animal waste collection device 10, as described hereinafter.

The linkage 17 comprises a second end that is connected to a pick-up and collection device 12 at a transmission element 21 that is illustrated in phantom in FIG. 1. The transmission element 21 (hereinafter "transmission element") moves components of the pick-up and collection device 12, as embodied by the invention and described in detail hereinafter in response to a user of the animal waste collection device 1 manipulating the actuator assembly 20 for a user to support and operate the animal waste collection device 10, as described hereinafter.

The linkage 17 can comprise any appropriate material and configuration for transmitting motion from the actuator assembly 20 to the pick-up and collection device 12. For example, and in no way limiting of the invention, the linkage 17 can comprise a metallic cable, a chain, string or rope, nylon and other synthetic material, or other appropriate materials. One exemplary embodiment of the invention provides a linkage 17 comprising a metallic cable.

Figure 2:
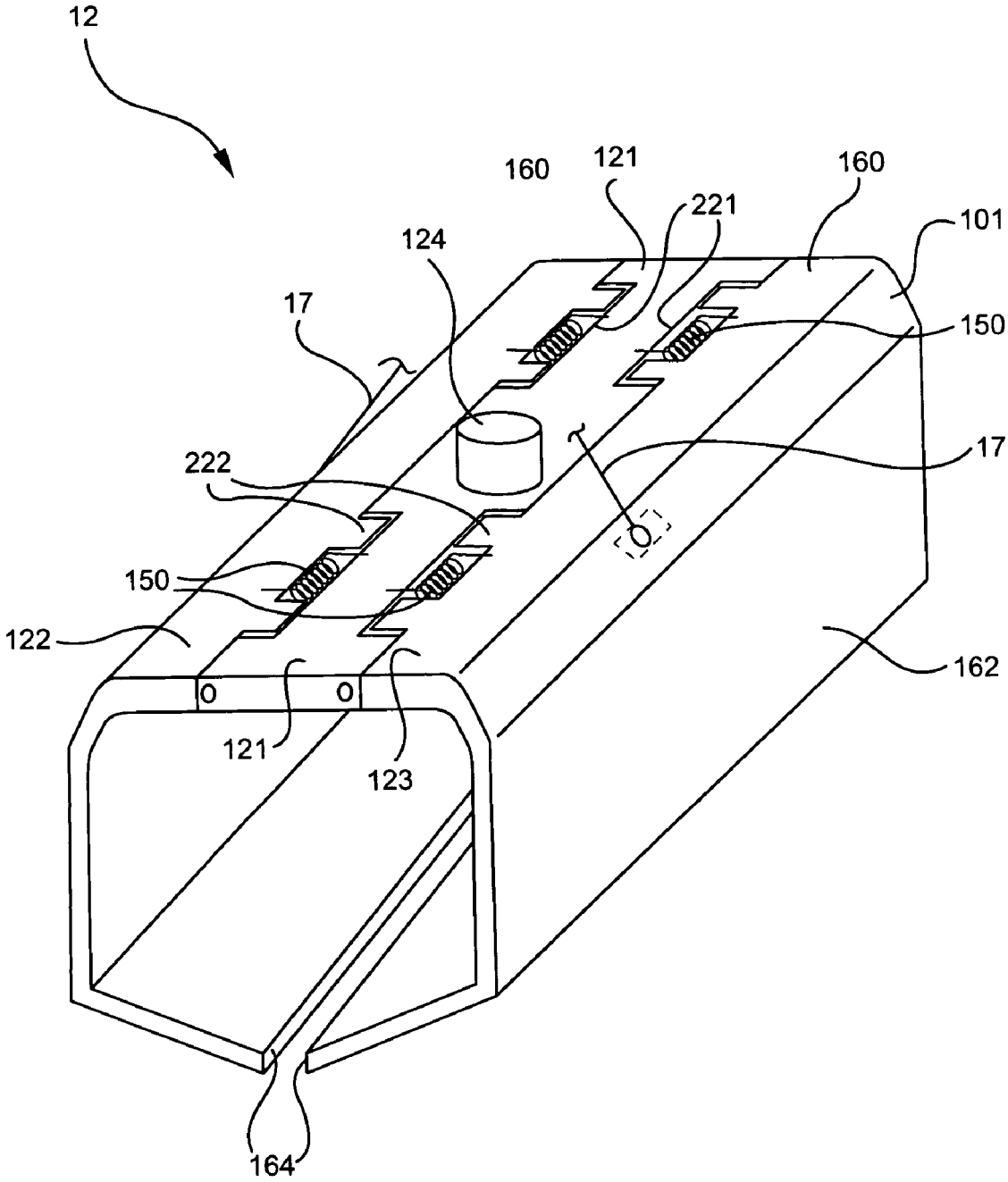
FIG. 2 is a schematic front-view illustration of the pick-up and collection device for an animal waste collection device, as embodied by the invention.
Figure 3:
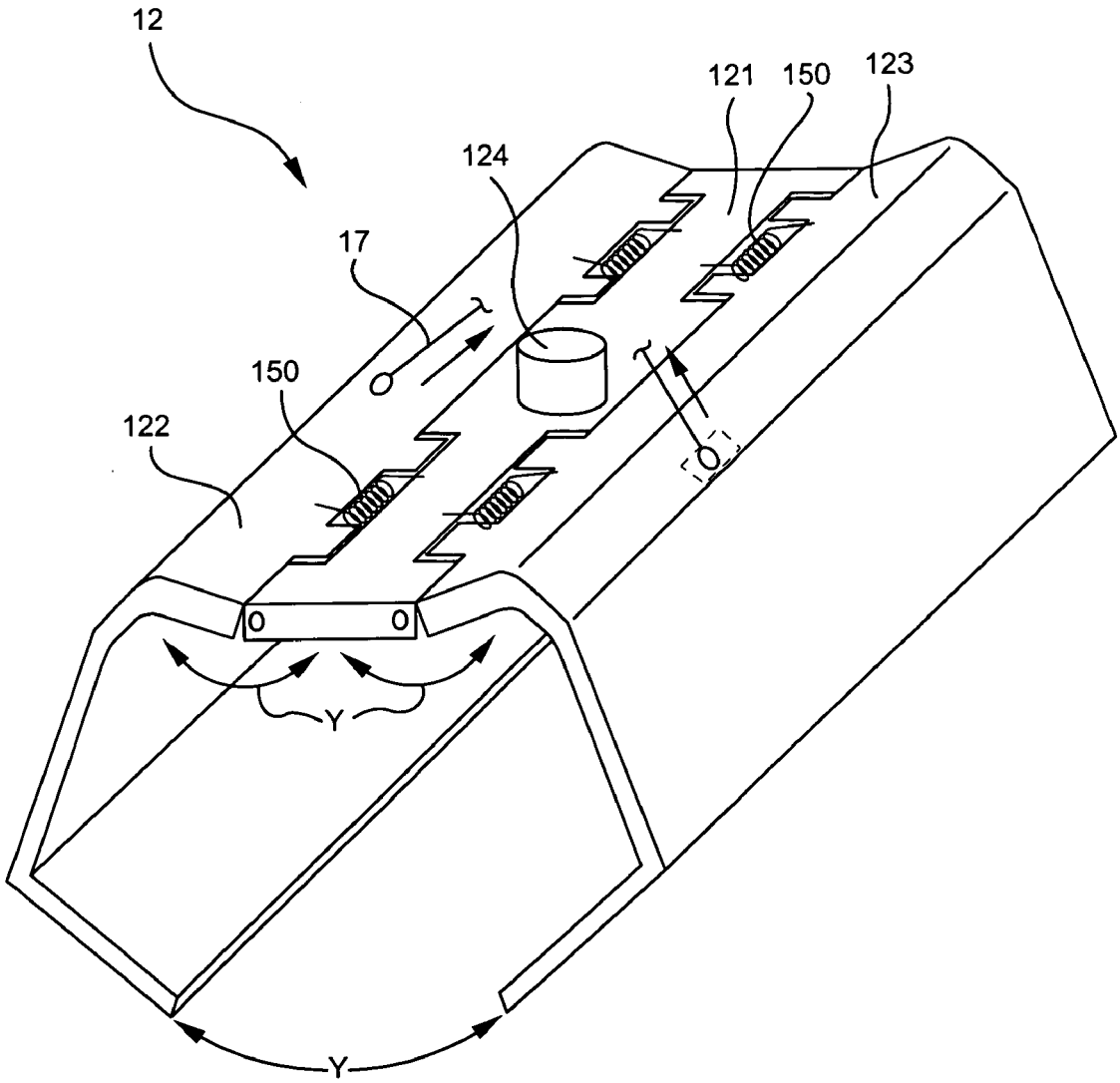
FIG. 3 is a schematic front-view illustration of the pick-up and collection device in an open position for an animal waste collection device, as embodied by the invention.

The pick-up and collection device 12 is illustrated in FIG. 1 and in further detail in FIGS. 2 and 3. The pick-up and collection device 12, as embodied by the invention, comprises an elongated base member 121. In the animal waste collection device, as embodied by the invention, illustrated in FIGS. 1–3, the elongated base member 121 comprises an elongated, generally-planar, base member 121 (herein after "elongated base member") and a plurality and at least two movable collection members 122 and 123. The at least two movable collection members 122 and 123 of the pick-up and collection device closure member 12 (hereinafter "closure member") and the elongated base member 121 form a complementary configuration, as illustrated in FIGS. 1 and 2 to close the pick-up and collection device 12 in a closure member closed position.

The elongated base member 121 comprises generally planar surface with a ferrule 124 mounted thereon. The ferrule 124 is open in its interior and is configured to accept the handle 11 of the animal waste collection device 1, as embodied by the invention. As illustrated in FIG. 1, the ferrule 124 of the elongated base member 121 and handle 11 mate in an orientation to present an angular relationship of the handle 11 and the pick-up and collection device 12. This orientation is schematically set forth in FIG. 1. Thus, a user of the animal waste collection device 1 can hold the handle out from her body and the pick-up and collection device 12 will be generally horizontal to the ground to collect waste.

The elongated base member 121 is generally planar on each of its upper and lower surfaces. The ends of the pick-up and collection device 12 are essentially coplanar with abutting ends of the at least two movable collection members 122 and 123, as illustrated in the FIGURES. The elongated base member 121 further comprises throughbores 125 that extend the length of the elongated base member 121. The elongated base member 121 also comprises a plurality of cut-outs 221. As illustrated in the Figures, the elongated base member 121 comprises 4 slots 221. These slots 221 are configured to receive complementary tabs 222 and cutouts or grooves 322 of the movable collection members 122 and 123, as will be described hereinafter. These slots 221 and tabs 222 and cutouts or grooves 322 are also configured to receive biasing members 150 that bias movable collection members 122 and 123 to their closed position, as illustrated in FIG. 1 and described herein. The action and configuration of the biasing members 150, as embodied by the invention, will be described hereinafter.

Pins 126 are inserted through the throughbores 125, the biasing members 150, plurality of slots 221 and tabs 222 and cutouts or grooves 322, and into corresponding passages in the movable collection members 122 and 123. The pins 126, as embodied by the invention, act to retain the biasing members 150 on the pick-up and collection device 12 and also retain the movable collection members 122 and 123 to the elongated base member 121.

The pins 126 also form a pivot axis for the movable collection members 122 and 123 about the elongated base member 121 when a user of the animal waste collection device 1 desires to open the pick-up and collection device 12. The pivot axis defined by the pins 126 permits the movable collection members 122 and 123 to pivot about the pins in the direction of arrows Y, as illustrated in FIG. 3, where the pick-up and collection device 12 of the animal waste collection device 1 is in an open position or orientation.

The pins 126, as embodied by the invention, can each be singular units that extend from one side of the pick-up and collection device 12 to the other side of the pick-up and collection device 12. Alternatively, each pin 126 may comprise two or more separate unit pins that cooperate with the biasing members 150. The pins 126 can be formed from any suitable materials, such as, but not limited to, metallic materials. Further, the pins 126 can be molded with one of the components, such as but not limited to one of the movable collection members 122 and 123 or the elongated base member 121, and then fit with the other of the movable collection members 122 and 123 or the elongated base member 121. The above are merely exemplary of the various configurations within the scope of the invention, and are not meant to limit the invention in any way.

Each of the movable collection members 122 and 123, as embodied by the invention, are essentially mirror images of each other for ease of manufacture, simplicity of operation, economy of scale and other similar grounds. For ease of description, only a single one of the movable collection members 122 and 123 will be described. It will be apparent to a person of ordinary skill in the art that the description of one of the movable collection members 122 and 123 will apply to the other of the movable collection members 122 and 123.

The movable collection members, as embodied by the invention, are illustrated in FIGS. 1–3. The biasing members 150 are not illustrated in FIGS. 2 and 3 to further illustrate the configuration of the pick-up and collection device 12. Each movable collection member comprises a multi-sided configuration, as illustrated in the Figures. While the instant movable collection member, as embodied by the invention, will be described with an exterior and interior having four faces, this configuration is merely exemplary. Other configurations of the movable collection member, as embodied by the invention, are contemplated and within the scope of the invention.

The figures illustrate the biasing members 150 as a coil spring, however, this configuration of the biasing members 150 is merely exemplary of biasing elements within the scope of the invention. Other such biasing members, such as but not limited to, leaf springs, torsion springs, tension springs, and the like may employed for the biasing members 150, as long as the functionality and purpose of the biasing members 150, as embodied by the invention, are maintained.

The biasing members 150, as embodied by the invention and illustrated in FIG. 1, comprise a coil spring with legs 151 and a coiled body 152. The pin 126 extends through the coiled body 152 of the biasing members 150. One of the legs 151 of each respective biasing member 150 extends onto the elongated base member 121 and the other leg 151 of the biasing members 150 extends onto the respective movable collection members 122 and 123. The leg 151 of the biasing members 150 that is positioned on the elongated base member 121 is essentially stationary during opening and closing of the movable collection members 122 and 123 of the pick-up and collection device 12. The leg 151 of the biasing members 150 that extends onto the movable collection members 122 and 123 moves with the respective movable collection member.

As the actuation assembly 20 is operated by a user of the animal waste collection device 1, as embodied by the invention, the movable collection members 122 and 123 are pivoted about the pins 126 in the directions Y (FIG. 3). During such pivoting, each of the legs 151 that extend onto the movable collection members 122 and 123 are moved in the direction of arrow Y towards the other leg 151 that is essentially stationary, thus compressing the biasing members 150. When a user of the animal waste collection device 1 releases the actuation assembly 20 thus releasing forces rotating the legs 151 toward each other, the movable collection members 122 and 123 pivot about the pins 126 toward the closed (and wasted collected position) shown in FIGS. 1 and 2, but illustrated without a bag for collection and receipt of the animal waste, as embodied by the invention.

The configuration of each movable collection member in the animal waste collection device 1, as embodied by the invention, is such that the part of the movable collection member that is opposite the pin 126 abuts in close proximity with another end of the movable collection member of the pick-up and collection device 12 of the animal waste collection device 1. With reference to the FIGURES, each movable collection member, as embodied by the invention, comprises a generally flat planar side 160, an angled connection side 161, an elongated side 162, and a collection side 163. Each of the movable collection members 122 and 123 and the elongated base member 121 are configured, so that when the animal waste collection device 1, as embodied by the invention, is in the closed position, as illustrated in FIGS. 1 and 2, to form a substantially closed unit with openings at ends of its longitudinal axis X (FIG. 1).

The collection side 163 comprises an edge 164 at the side of each movable collection member opposite the pin 126. When the pick-up and collection device 12 is in the closed position, edges 164 of the collection side 163 are juxtaposed in essentially side by side relationship. Thus, if the pick-up and collection device 12 is opened (FIG. 3), the edges 164 are positioned apart from each other. In the positioned apart orientation, a user can insert a bag of suitable configuration, such as but not limited to that described in U.S. patent application Ser. No. 10/719,156, filed Nov. 21, 2003, by Jung, the entire contents of which are incorporated herein by reference, can be fit to the pick-up and collection device 12 of the animal waste collection device 1, as embodied by the invention.

The materials of movable collection members 122 and 123 can comprise any suitable material. In some embodiments of the animal waste collection device 1, as embodied by the invention, the movable collection members 122 and 123 are formed from a washable durable material. For example, and in no way limiting of the invention, the movable collection members 122 and 123 can be formed from a plastic material, a metallic material, naturally occurring materials including wood, and combinations thereof. These materials are merely exemplary and are not intended to limit the invention in any manner.

When the user of the animal waste collection device 1 applies a force at actuator assembly 12 to open the pick-up and collection device 12, the movable collection members 122 and 123 of the pick-up and collection device 12 pivot about the respective pins 126 to a closed position against the force of the biasing members 150, as described above. In that closed position, the edges 164 are juxtaposed in essentially side-by-side relationship. Thus, any waste between the movable collection members 122 and 123 can be collected by a bag (not illustrated), used with the animal waste collection device 1, as embodied by the invention.

The generally flat planar side 160 comprises a set of cutouts or grooves 221 (hereinafter "slot" 221), as best illustrated and viewed in FIG. 2. These slots 221 in the elongated base member 121 cooperate with tabs 222 and cutouts or grooves 322 in the elongated base member 121. This construction of the tabs 222 and cutouts or grooves 322 and slots 221 in the elongated base member 121 cooperate with the biasing members 150 to position and retain the biasing members 150 on the pins 126. While the illustrated embodiment of the animal waste collection device 1 comprises slots 221 on the elongated base member 121 and tabs 222 and cutouts or grooves 322 on the generally flat planar side 160, the slots can be provided on the generally flat planar side 160 and the tabs and cutouts or grooves can be provided on the elongated base member 121.

As illustrated, the animal waste collection device 1, as embodied by the invention, comprise the pick-up and collection device 12 with the elongated base member 121 having cutouts or grooves 221. In FIG. 2, the generally flat planar side 160 comprises at least two tabs 222 with a cutout or groove 322 interspaced there between. The biasing members 150 are positioned in the cutout or groove 322 with the coiled body 152 of the biasing members 150 positioned therein as the pins 126 extends through the coiled body 152 of the biasing members 150. The legs 151 of the biasing members 150 extend beyond the periphery of the cutouts or grooves 322 and slot 221 to rest on the generally flat planar side 160 and the elongated base member 121, respectively.

The transmission element 21 comprises a mechanical device that can transfer movement from the linkage 17 to each movable collection members 122 and 123. The movement is transferred between the linkage 17 and the movable collection members 122 and 123 by a linkage extension or enlargement 170 (FIG. 1) that is operatively connected to each movable collection members 122 and 123 to transmit movement therebetween.

Exemplary configurations of the transmission element 21, linkage 17, and linkage extension or enlargement 170 can comprise, but are not limited to, the transmission element 21 comprising a post, in which the linkage 17 simply extends around the post transmission element 21 to each movable collection members 122 and 123. The linkage 17 connects with, is integrally connected with, or is one-piece with the linkage extension or enlargement 170 that can be connected to each movable collection members 122 and 123. Thus, a movement of the linkage 17 moves the linkage extension or enlargement 170 that results in movement of a movable collection members 122 and 123.

The linkage 17 may be integral with, connected therewith, or one-piece with the linkage extension or enlargement 170 in conjunction with the transmission element 21. Regardless of the connection between the transmission element 21, linkage 17, and linkage extension or enlargement 170, movement of the linkage 17 will move the linkage extension or enlargement 170 about the transmission element 21. This connection and associated movement will result in a movable collection members 122 and 123 being moved, in a manner as embodied by the invention.

The linkage 17 may comprise a cable formed from any appropriate material metals, plastics, natural materials (strings, yarns, and the like), chains, and combinations thereof. The connections of the linkage 17 to the transmission element 21 and the actuation assembly 20, and the connection of the linkage extension or enlargement 170 to the at least one of the transmission element 21 and the linkage 17 (if integrally connected thereto) can comprise any appropriate connection between the respective elements.

Figure 4:
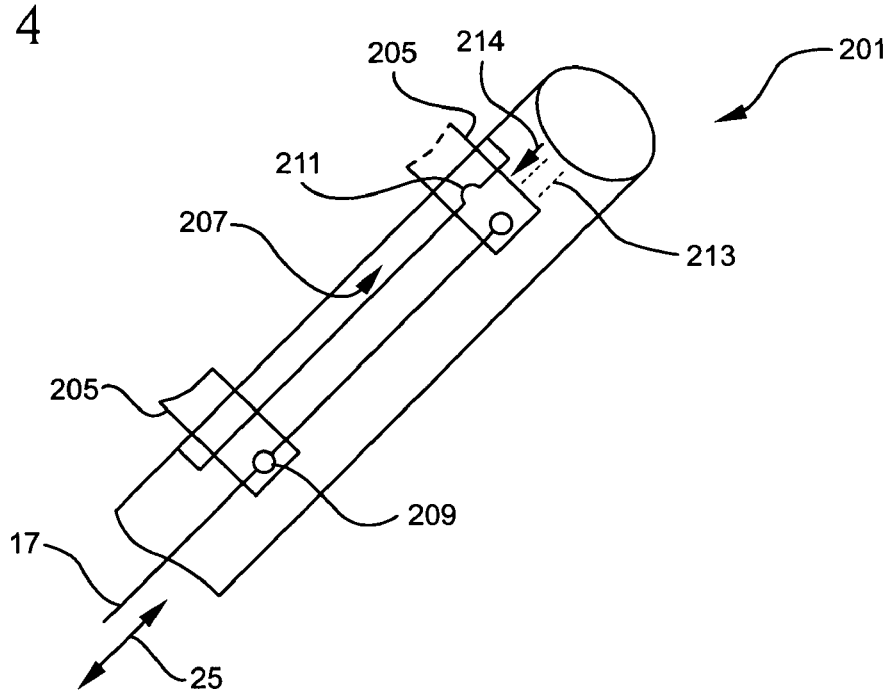
FIG. 4 a schematic illustration of a handle and actuator assembly of an animal waste collection device, as embodied by the invention.
Figure 5:
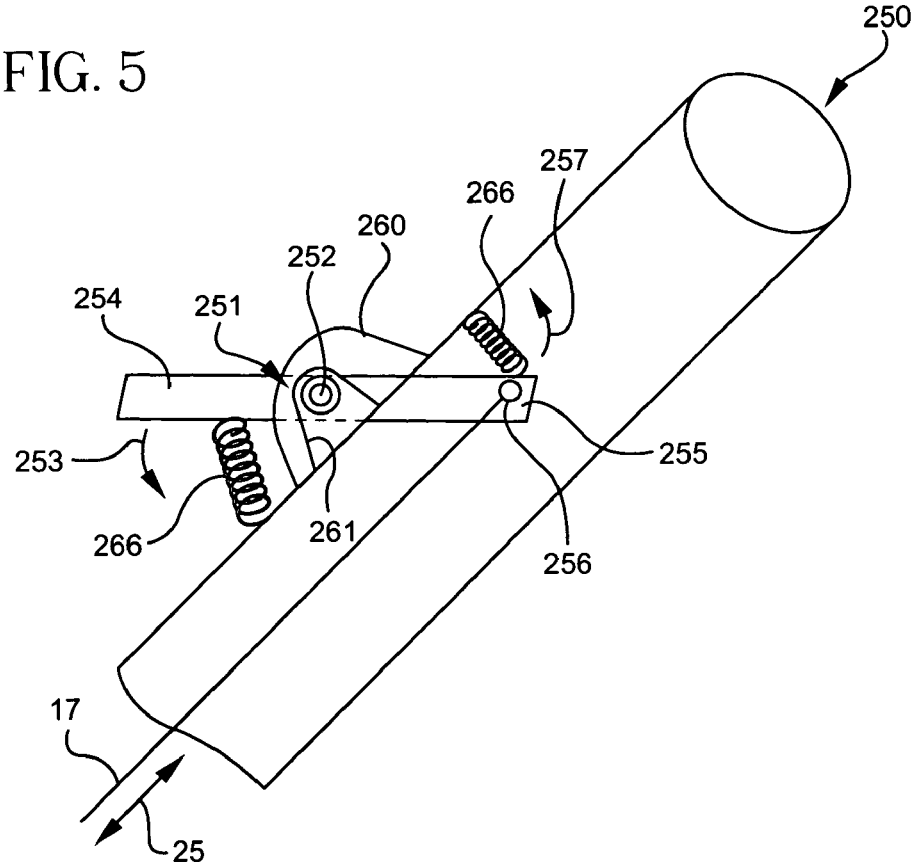
FIG. 5 is a schematic illustration of a further handle and actuator handle assembly of an animal waste collection device, as embodied by the invention.

FIGS. 4 and 5 illustrate exemplary configurations for an actuator assembly 20 within the scope of the invention. Each actuator assembly, 201 and 250, as illustrated in FIGS. 4 and 5, respectively, are merely exemplary of the actuator assemblies within the scope of the invention that can impart movement to the linkage 17, as described above. These configurations are not intended to limit the invention in any manner.

The actuator assembly 201 of FIG. 4 comprises a button actuator assembly 201. The button actuator assembly 201 comprises a hand or finger slidable movable button 205. The button 205 is connected to the linkage 17 at connection 209, in which movement of the button 205 imparts movement to the linkage 17. The button 205 is movable by a user of the animal waste collection device 10 to transmit movement to the linkage 17 in the direction of arrow 25. The button 205 is illustrated in a first position (solid lines) in which the linkage 17 has not been moved to open the closure member. The button 205 is movable in a slot 207 in the second end 15 of the elongated handle 11 by a hand or finger of the user to a second position (illustrated in phantom in FIG. 4). In the second position, the button 205 has moved the linkage 17 to open the slot-like aperture 131 of the pick-up and collection device 12 for collecting waste. The button 205 can be moved against a return force of a biasing element 213, which acts to bias the button 205 in the direction of arrow 214 toward the first position, and the closed position of the pick-up and collection device 12.

The actuator assembly 201 can comprise a detent 211 to maintain the button 205 in the second position. The detent 211 can comprise any appropriate detent structure that can act to maintain the button 205 in the second position so the pick-up and collection device 12 is open, and the animal waste collection device 1 can collect waste, as embodied by the invention. For example, and in no way limiting of the invention, the detent 211 can comprise at lest one of a self-locking detent, a latch, a spring-biasing detent, a manually-actuated detent (in which the user moves the detent 211 into a latching position with the button 205), and combinations thereof. The above-described detents are merely exemplary of the detent structures within the scope of the invention, and should not be construed as limiting of the invention.

Further, if a biasing element 213 is provided to return the button 205, the detent 211 can hold the button in the second position including against the return force of the biasing element 213 (if provided). Thus, the user of the animal waste collection device 10 need only move the button 205 to the second position, at which time the detent 211 can hold the button 205 in the second position. The user can pick up waste and then may release the detent 211 (if a manually actuated detent) by simply applying pressure to the button 205 to overcome the detent 211. Therefore, the button 205 can return to the first position in which the pick-up and collection device 12 is closed.

Alternatively, as embodied by the invention, a lever actuator assembly 250 as illustrated in FIG. 5 may be provided. The lever actuator assembly 250 of FIG. 5 is moved by a hand or finger of the user to move the lever 251 about a pivot 252 in the direction of arrow 253. The lever 251 comprises a first end 254 at which end the user of the animal waste collection device 10 provides a force to move the lever 251 about the pivot 252. The pivot 252 can be formed integral with the first end 15 of the elongated handle 11, and alternatively, the pivot 252 can be formed with a boss 260 on the first end 15 of the elongated handle 11, in which the boss 260 enhances the pivoting movement and degree of possible pivoting of the lever 251.

Once the lever 251 is moved about its pivot 252, the other end 255 of the lever 251 is moved in the direction of arrow 257. The other end 255 comprises a connection 256 of the lever 251 t the linkage 17, so that when the other end 255 is moved in the direction of arrow 257, the linkage is moved in the direction indicated the arrow 25. Thus, movement can be transmitted to the closure member to open the slot-like aperture 131, and the user of the animal waste collection device 10 can collect waste, as needed.

The actuator assembly 250 of FIG. 5 can also comprise a biasing element to move the actuator assembly 250 in a position in which the linkage 17 opens the pick-up and collection device 12. For example, the actuator assembly 250 can comprise a spring 261 that is included at the pivot 252 to move the first end 254 of the lever 251 in a direction opposite the arrow 253. Alternatively, the actuator assembly 250 may comprise at least one biasing element 266 that is disposed proximate either end, 254 and 255, of the lever 251. Further, both of the biasing elements 266 illustrated in FIG. 5 may be provided together, in which the biasing elements 266 act to return the lever 251 to an unbiased position. As a further alternative within the scope of the invention, the actuator assembly 250 may comprise each respective biasing element all acting in cooperation with one another.

Figure 9:
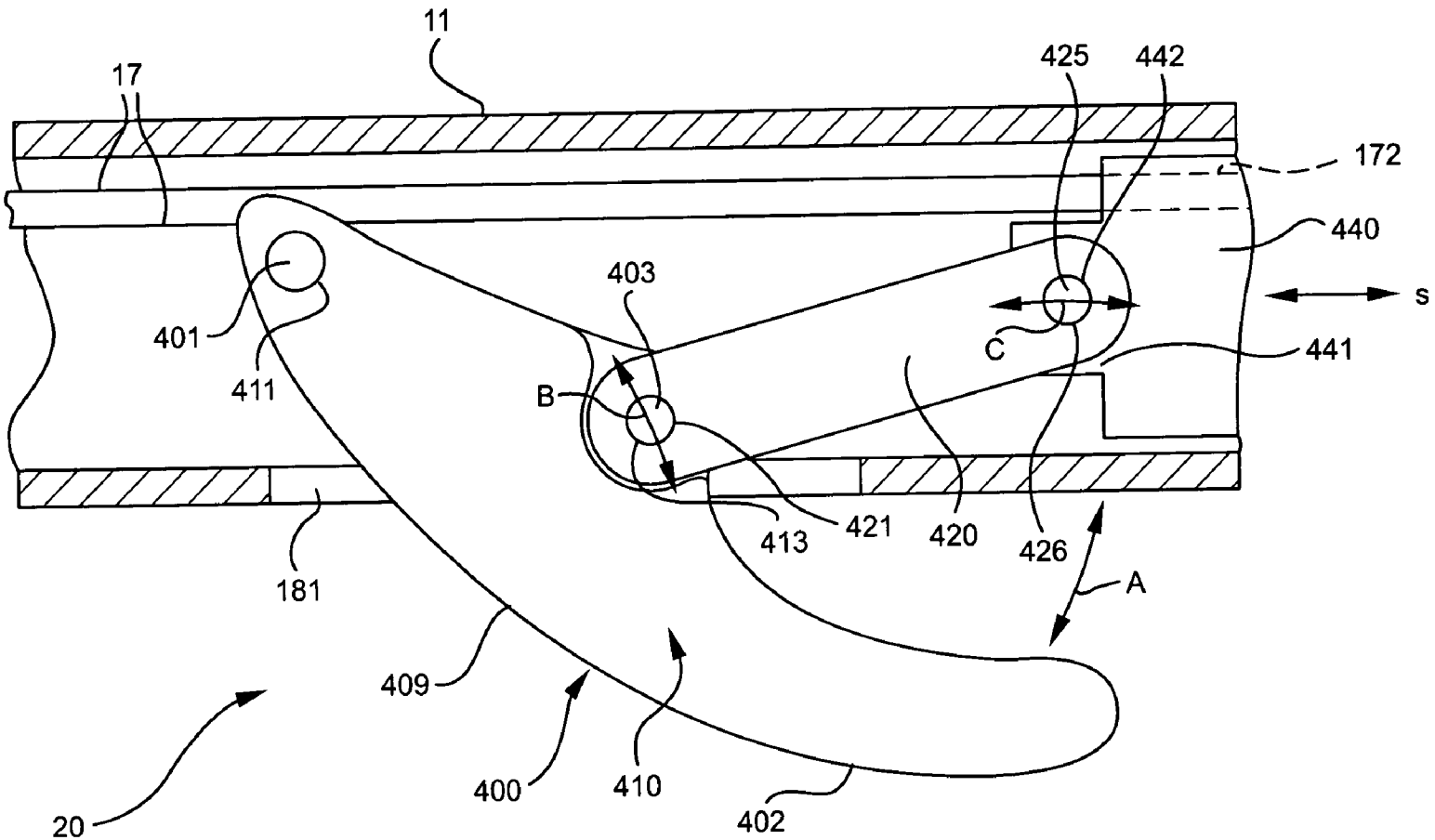
FIG. 9 is a schematic, part sectional, illustration of yet another further handle and actuator handle assembly of an animal waste collection device, as embodied by the invention.

FIG. 9 is a schematic, part sectional, illustration of yet another further handle and actuator handle assembly of an animal waste collection device, as embodied by the invention. In FIG. 9, the actuator assembly 20, as embodied by the invention, comprises a multi-part lever apparatus for moving the movable collection members 122 and 123, as embodied by the invention. The multi-part lever apparatus 400, as embodied by the invention, comprises a lever 410, a lever linkage 420, and a linkage 17 sliding holder 440 (hereinafter "sliding holder 440"). The illustrated configuration of the multi-part lever apparatus 400 is shown with three elements, however, the scope of the invention is such that any number of levers and linkages can be provided as long as the movement of the multi-part lever apparatus 400 imparts movement to the movable collection members 122 and 123.

The lever 410, as embodied by the invention, comprises an elongated curved member with a contact surface 409 that a user of the animal waste collection device will grasp and move in the direction of arrow A to move the movable collection members 122 and 123, as described herein. The lever 410 comprises a pivot pin 401 that extends through the lever 410 and into the handle 11, so that the pivot pin 401 is held stationary with respect to the handle 11. The pivot pin 401 is inserted through an aperture 411 in the lever 410, so as to be held stationary with respect to the handle 11.

An intermediate portion 405 of the lever 410 comprises another aperture 413 through which a further pivot pin 403 is inserted. This pivot pin 403 connects the lever 410 to the lever linkage 420. The intermediate portion 405 of the lever 410 or the area of the lever linkage 420 at the pin 403 may be an area of reduced thickness so that the lever linkage 420 and lever 410 provide surfaces that are essentially complementary and coplanar. Thus, a relatively smooth transition between the lever linkage 420 and lever 410 is provided.

The lever linkage 420 comprises a member that connects the lever 410 to a sliding holder 440. The sliding holder 440 is connected to the lever linkage 420 in a manner to impart movement to sliding holder 440 in the direction of arrow S (FIG. 9) when the lever 410 is pivoted about pivot pin 401, as described herein. The sliding holder 440 comprises the ends of linkages 17. The ends of linkages 17 may be molded with the sliding holder 440, inserted through the sliding holder 440, for example, in passages 172 provided in the sliding holder 440, or otherwise attached to the sliding holder 440. Thus, as the sliding holder 440 is moved in the direction of arrow S, the ends of ends of linkages 17 will move (in a reciprocal manner and direction) and thus, the movable collection members 122 and 123 will be open and closed.

As illustrated in FIG. 9, pivoting of the lever 410 in the direction of arrow A about pivot pin multi-part lever apparatus 401 moves the pivot pin 403 in the direction of arrow B. This movement of pivot pin 403 moves the lever linkage 420 in a reciprocal manner in the interior 18 of the handle 17 in the direction of arrow C, as embodied by the invention. The movement of the lever linkage 420 in a reciprocal manner in the interior 18 of the handle 17 in the direction of arrow C moves the sliding holder 440 in the direction of arrow S. Thus, the linkage 17 moves to open and close the movable collection members 122 and 123.

Figure 6:
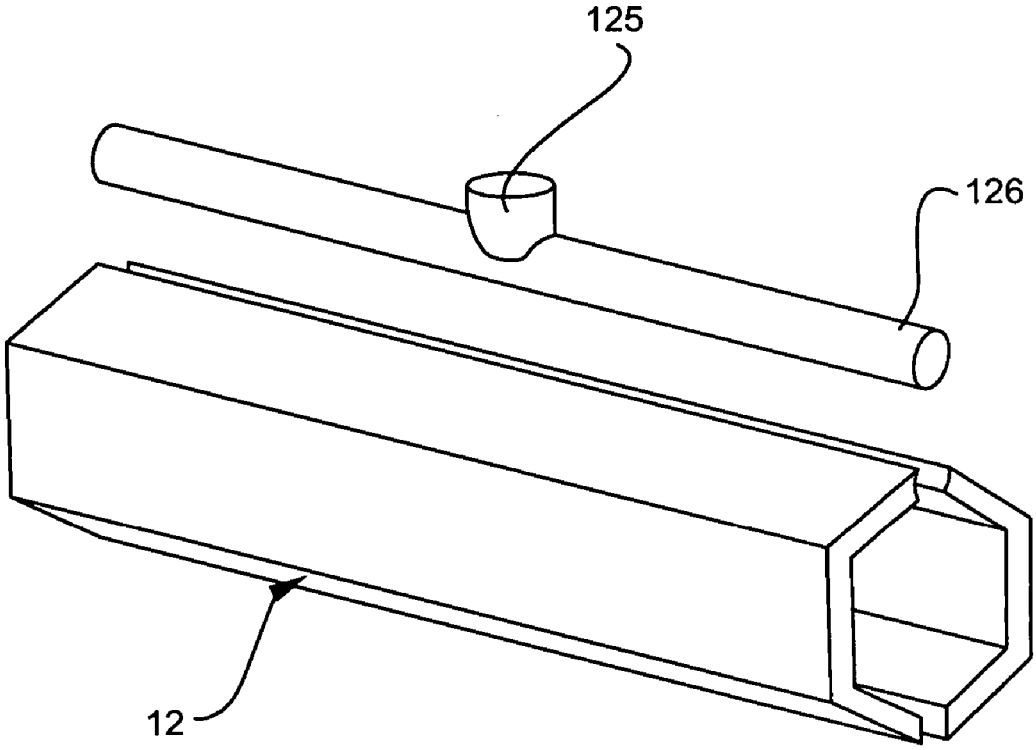
FIG. 6 is a schematic exploded perspective illustration of a further animal waste collection device, as embodied by the invention.
Figure 7:
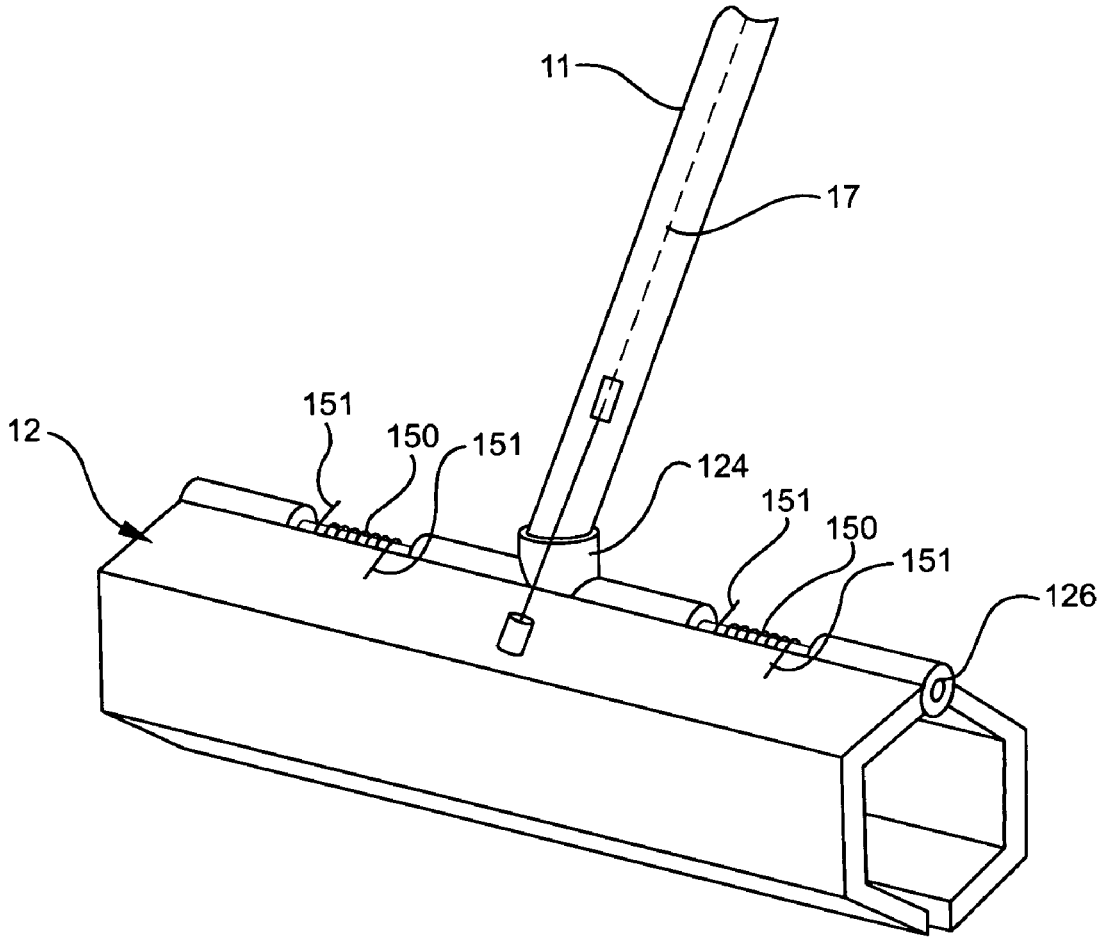
FIG. 7 is a schematic exploded perspective illustration of a further animal waste collection device, as embodied by the invention.
Figure 8:
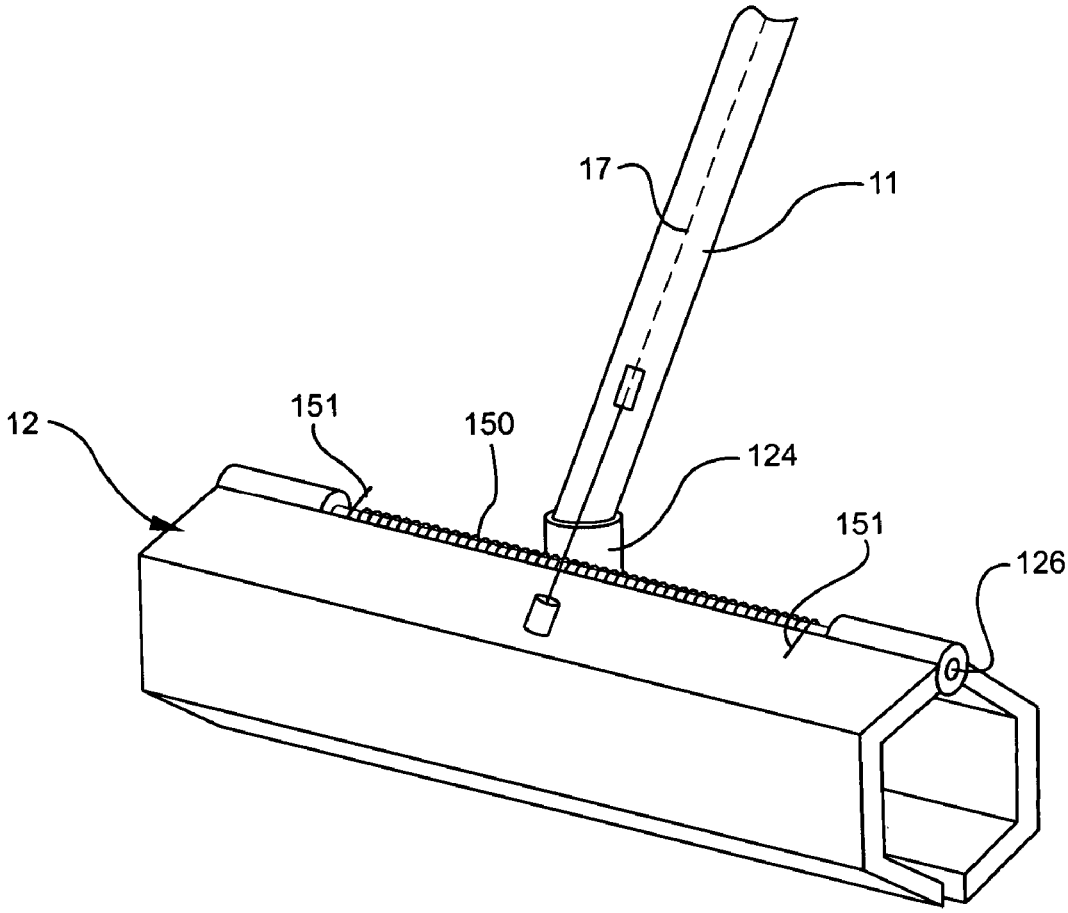
FIG. 8 is a schematic exploded perspective illustration of a further animal waste collection device, as embodied by the invention.

FIGS. 6–8 illustrate a schematic exploded perspective illustration of further animal waste collection devices, as embodied by the invention. In the animal waste collection devices of FIGS. 6–8, the configuration of the pick-up and collection device 12 is similar to that in the embodiments described above and a further description will not be provided.

The animal waste collection device of FIGS. 6–8 comprises an elongated base member 300. The base member 300 of the animal waste collection device, as embodied by the invention, is an elongated base member 300. The animal waste collection device, as illustrated in FIGS. 6–8, comprises an elongated base member 300 that comprises elongated, generally-cylindrical, base member 321. The elongated, generally-cylindrical, base member 321 is formed in a substantially tubular fashion with a throughbore there through to accept a pin 126. The pin 126 acts to retain the movable collection members 122 and 123 of the pick-up and collection device 12 onto the elongated, generally-cylindrical, base member 321, in a similar fashion as the pin in the pick-up and collection device 12 of FIGS. 1–3.

Further, the elongated, generally-cylindrical, base member 321 and the movable collection members 122 and 123 of the pick-up and collection device 12 also comprise a slot, tab, and groove configuration as illustrated in FIGS. 1–3. This slot, tab, and groove configuration is not illustrated in these figures for ease of understanding.

The animal waste collection device as illustrated in FIGS. 6–8 also includes biasing members 150. These biasing members 150 bias the movable collection members 122 and 123 to their closed position, as described above. The description of the biasing members 150 is provided above. In FIG. 7, there are two biasing members 150 provided in the elongated, generally-cylindrical, base member 321 for biasing movable collection members 122 and 123 to their closed position. In FIG. 8, there is one biasing member 150 provided in the elongated, generally-cylindrical, base member 321 for biasing movable collection members 122 and 123 to their closed position. The scope of the invention includes any number of biasing members 150 for biasing movable collection members 122 and 123 to their closed position.

A bag for use with the animal waste collection device, as embodied by the invention and disclosed herein, is described in U.S. patent application Ser. No. 10/719,156, filed Nov. 21, 2003, by Jung. Although that bag of in U.S. patent application Ser. No. 10/719,156 can be used herewith, other bags of various constructions and configurations are also contemplated within the scope of the invention for use with the instant animal waste collection device 10. Reference is made to in U.S. patent application Ser. No. 10/719,156 for a description of one bag for use with the animal waste collection device 10. Further descriptions of the bag in U.S. patent application Ser. No. 10/719,156 and other bag that can be suitable for use with the animal waste collection device 10, as embodied by the invention, will be omitted for clarity purposes.

Therefore, the animal waste collection device, as embodied by the invention, can provide a convenient, one-handed device for the neat and easy collection of animal waste. The animal waste collection device, as embodied by the invention, overcomes the above-noted deficiencies of known pooper-scoopers, and also avoids soiling of the animal waste collection device features. Thus, a user of the animal waste collection device need not clean the animal waste collection device after each use. Of course, the animal waste collection device, as embodied by the invention, comprises materials that are readily cleaned, such s but not limited to, plastic, metals, and combinations thereof.

While embodiments of the invention have been described, the present invention is capable of variation and modification, and therefore should not be limited to the description herein. The invention includes changes and alterations that fall within the purview of the following claims. Individual components of the described and illustrated embodiments may be used interchangeably with each other component of the described and illustrated embodiments.

What is claimed:

1. An animal waste collection device for collecting waste into a bag without soiling a user of the animal waste collection device, the animal waste collection device comprising:

an elongated handle, the elongated handle comprising an actuator assembly at one end of the elongated handle;

a pick-up and collection device disposed at an end of the elongated handle from the actuator assembly, the pick-up and collection device comprising movable collection members and an elongated base member, the movable collection members being movably connected to the elongated base member, the elongated base member being fixed to the handle of the animal waste collection device;

a linkage operably connected at a first end to the actuator assembly and extending between the actuator assembly and the pick-up and collection device;

a transmission element operably connected to the linkage at the pick-up and collection device, the transmission element also being operably connected to the movable collection members for transmitting movement from the actuator assembly, through the linkage and the transmission element to each of the closure members to move each of the movable collection members between open and closed movable collection members positions; and wherein the pick-up and collection device is adapted to receive a bag for receiving and storing animal waste collected by the animal waste collection device;

wherein the open end of the bag can be secured to the pick-up and collection device to provide access to an interior of the bag when the actuator assembly moves the movable collection members to the open position for collecting waste, further wherein the animal waste collection device can collect waste without soiling a user of the animal waste collection device nor soiling the animal waste collection device, and wherein each of the movable collection members are connected to the elongated base member in a pivoting movable configuration by at least one pin and are connected to the elongated base member by at least one biasing member, and wherein each movable collection member comprises a generally flat planar side, an angled connection side, an elongated side, and a collection side, and the movable collection members and the elongated base member are configured, so that when the animal waste collection device is in the closed position to form a substantially closed unit with openings at ends of a longitudinal axis of the pick-up and collection device, and the generally flat planar side of the movable collection member comprises a set of slots that cooperate with tabs and cutouts in the elongated base member to position and retain the biasing members on the pins, and further wherein the at least one biasing member each comprise a coil spring, the coil spring comprising at least two legs and a coiled body, the at least one pin extending through each coiled body of a respective biasing members, one of the legs of each respective biasing member extending onto the elongated base member and the other leg of the biasing members extends onto the respective movable collection members, and further the leg of the biasing members that is positioned on the elongated base member is essentially stationary during opening and closing of the movable collection members of the pick-up and collection device and the leg of the biasing members that extends onto the movable collection members moves with the respective movable collection member during opening and closing of the movable collection members of the pick-up and collection device.

2. A device according to claim 1, wherein each of the movable collection members are connected to the elongated base member in a pivoting movable configuration by at least one pin.

3. A device according to claim 2, wherein the at least one pin extends from one side of the pick-up and collection device to the other side of the pick-up and collection device.

4. A device according to claim 3, wherein each pin comprises at least one unit can be molded with one of the movable collection members or the elongated base member, and then fit with the other of the movable collection members or the elongated base member.

5. A device according to claim 1, wherein each of the movable collection members is connected to the elongated base member by at least one biasing member.

6. A device according to claim 1, wherein the at least one biasing member each comprise a coil spring, the coil spring comprising at least two legs and a coiled body, the at least one pin extending through each coiled body of a respective biasing members, one of the legs of each respective biasing member extending onto the elongated base member and the other leg of the biasing members extends onto the respective movable collection members, and further the leg of the biasing members that is positioned on the elongated base member is essentially stationary during opening and closing of the movable collection members of the pick-up and collection device and the leg of the biasing members that extends onto the movable collection members moves with the respective movable collection member during opening and closing of the movable collection members of the pick-up and collection device.

7. A device according to claim 1, wherein the linkage comprises a linkage extension that leads from the transmission element to the closure member, wherein movement of the linkage can be transmitted to the linkage extension to move the closure member.

8. A device according to claim 1, wherein the actuator assembly is movable from a first position that corresponds to a closed position of the pick-up and collection device to a second position that corresponds to an open position of the pick-up and collection device.

9. A device according to claim 8, wherein the bag actuator assembly comprises a latch to hold the actuator assembly in the first position.

10. A device according to claim 8, wherein the actuator assembly comprises a button that is movable in a slot in the actuator assembly between the first and second positions.

11. A device according to claim 8, wherein the bag actuator assembly comprises:

a lever, a lever linkage, and a linkage sliding holder, wherein the lever comprises an elongated curved member with a contact surface that a user of the animal waste collection device will grasp and move to move the movable collection, the lever linkage connects the lever to the sliding holder to impart movement to the movable collection members to open and close the movable collection members.

12. A device according to claim 11, wherein the lever comprises a pivot pin that extends through the lever and into the handle, so that the pivot pin is held stationary with respect to the handle, an intermediate portion of the lever comprises another aperture through which a further pivot pin is inserted and is connected to the lever linkage, and wherein the sliding holder comprises the ends of linkages, so, the ends of linkages will move and impart movement to the movable collection members to open and close the movable collection members.

13. A device according to claim 1, wherein the actuator assembly comprises a lever that is movable between the first and second positions.

14. A device according to claim 1, wherein the animal waste collection device further comprises biasing elements to bias the movable collection members to a closed position.

15. A device according to claim 1, wherein the bag comprises a complementary configuration to the pick-up and collection device.

16. A device according to claim 1, wherein the elongated base member comprises a generally cylindrical elongated base member.

* * * * *